US008387970B2

(12) United States Patent
Ubayashi

(10) Patent No.: US 8,387,970 B2
(45) Date of Patent: Mar. 5, 2013

(54) SHEET FEEDING APPARATUS AND IMAGE FORMING APPARATUS

(75) Inventor: Shinsuke Ubayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 12/687,468

(22) Filed: Jan. 14, 2010

(65) Prior Publication Data

US 2010/0187754 A1 Jul. 29, 2010

(30) Foreign Application Priority Data

Jan. 29, 2009 (JP) ..... 2009-018817

(51) Int. Cl.
*B65H 1/22* (2006.01)

(52) U.S. Cl. ..... 271/164; 271/145; 271/162; 292/219; 292/224; 292/227; 292/228; 292/121; 292/124; 292/98; 292/DIG. 37

(58) Field of Classification Search ..... 271/162, 271/164, 145; 292/219, 224, 227, 228, 121, 292/124, 98, DIG. 37
See application file for complete search history.

(56) References Cited

U.S. PATENT DOCUMENTS

| | | | | |
|---|---|---|---|---|
| 5,419,544 | A * | 5/1995 | Ono et al. | 271/164 |
| 5,478,066 | A | 12/1995 | Yoshida et al. | |
| 5,645,274 | A | 7/1997 | Ubayashi et al. | |
| 5,722,652 | A | 3/1998 | Yoshida et al. | |
| 5,918,875 | A * | 7/1999 | Masley et al. | 271/162 |
| 6,082,728 | A | 7/2000 | Ubayashi | |
| 6,102,386 | A * | 8/2000 | Shigetomi et al. | 271/9.11 |
| 6,651,980 | B2 | 11/2003 | Isemura et al. | |
| 6,804,473 | B2 | 10/2004 | Nakamura et al. | |
| 6,994,483 | B2 * | 2/2006 | Jang | 400/629 |
| 7,424,261 | B2 | 9/2008 | Uchida et al. | |
| 7,513,541 | B1 * | 4/2009 | Gregory | 292/48 |
| 7,530,608 | B2 * | 5/2009 | Chen | 292/121 |
| 7,604,232 | B2 * | 10/2009 | Nakashima et al. | 271/164 |
| 7,604,265 | B2 * | 10/2009 | Tsai | 292/26 |
| 2008/0251996 | A1 | 10/2008 | Ubayashi | |
| 2009/0003866 | A1 | 1/2009 | Uchida et al. | |
| 2010/0044953 | A1 * | 2/2010 | Ohno et al. | 271/110 |

FOREIGN PATENT DOCUMENTS

| | | | |
|---|---|---|---|
| JP | 04201930 A | * | 7/1992 |
| JP | 2004-269147 | | 9/2004 |

OTHER PUBLICATIONS

Chinese Office Action dated Jun. 24, 2011, issued in counterpart Chinese Patent Application No. 201010106053.3, with an English translation.

* cited by examiner

*Primary Examiner* — Kaitlin Joerger
*Assistant Examiner* — Prasad V. Gokhale
(74) *Attorney, Agent, or Firm* — Fitzpatrick, Cella, Harper & Scinto

(57) ABSTRACT

A sheet feeding device includes a sheet storage portion mounted on a device main body so as to be drawn from the device main body and the sheet storage portion stores sheets, a sheet feeding portion that feed a sheet from the sheet storage portion, a pushing portion that applies a force to the sheet storage portion in a drawing direction where the sheet storage portion is drawn from the device main body, a locking mechanism configured to lock the sheet storage portion in the device main body, and a pressing operation member that is pressed in a direction opposite to the drawing direction. A lock of the locking portion is released while interlocking the release of the press of the pressing operation member.

6 Claims, 14 Drawing Sheets

SHEET FEEDING APPARATUS AND IMAGE FORMING APPARATUS

BACKGROUND OF THE INVENTION

1. Field of the Invention

The present invention relates to a sheet feeding device including a unit drawer device where a unit is mounted on a device main body so as to be drawn from the device main body, and an image forming apparatus that includes the sheet feeding device.

2. Description of the Related Art

For example, a copying machine, which is an image forming apparatus, generally has a function to read out an image of a document or the like, and forms an image on a sheet based on the read image information. However, in recent years, there is a copying machine that has a communication function or the like and a function to input image information to be sent from the outside. Further, a printer, which is an image forming apparatus, forms an image on a sheet based on image information that is generally sent from an external device, for example, a computer or the like.

A sheet feeding device, which feeds sheets to an image forming portion, is disposed at a lower portion or middle portion of an apparatus main body of each of these image forming apparatuses. The sheet feeding device includes a sheet storage portion as a unit and a sheet feeding portion that feeds sheets stored in the sheet storage portion. In general, after the sheet storage portion is drawn from the apparatus main body, the sheets are stored in the sheet storage portion.

Among these kinds of image forming apparatuses, there is an image forming apparatus that includes a unit drawer device for drawing a sheet storage portion. The unit drawer device includes a pressing operation member (button) that is pressed when the sheet storage portion is drawn from the apparatus main body, and a locking mechanism that locks the sheet storage portion to the apparatus main body. Further, the lock of the locking mechanism is released by a pressing operation of the pressing operation member that is performed by an operator (user), so that the sheet storage portion is drawn. This image forming apparatus includes a spring that applies a force to the sheet storage portion in a drawing direction. Accordingly, when the lock of the locking mechanism is released, the sheet storage portion protrudes from the apparatus main body so as to be apt to be drawn (see Japanese Patent Application Laid-Open No. 2004-269147).

FIG. 13 is a plan view illustrating a part of an apparatus main body and a sheet storage portion in the related art, and FIG. 14 is an enlarged plan view of the vicinity of a locking mechanism illustrated in FIG. 13.

A force is applied to a sheet storage portion 807 in a drawing direction (a direction of an arrow A in FIGS. 13 and 14) by a spring (not illustrated), and the sheet storage portion is locked by a locking mechanism 809. A rotating shaft 880*a* is formed at the sheet storage portion 807, and a hook 880 is rotatable mounted on the rotating shaft 880*a*. Further, the hook 880 is rotated by the linear motion of a slide member 882 that is connected to the pressing operation member 804.

The apparatus main body of the image forming apparatus is provided with a positioning pin 881 to which the hook 880 is locked. The hook 880 is locked to the positioning pin 881, so that the protruding of the sheet storage portion 807 from the apparatus main body is regulated. Further, when an operator presses the pressing operation member 804 in a direction of an arrow B, the slide member 882 is pressed and moved in the direction of the arrow B and the hook 880 is rotated so that the hook 880 is disengaged from the positioning pin 881. Accordingly, the sheet storage portion 807 protrudes in the direction of the arrow A by the force of a spring (not illustrated).

Meanwhile, in the apparatus including the above-mentioned locking mechanism 809, the drawing direction (the direction of the arrow A) where the sheet storage portion 807 is drawn by a spring (not illustrated) is opposite to the direction (the direction of the arrow B) where an operator presses the pressing operation member 804. Further, at the point of the separation of the hook 880 from the positioning pin 881, a force of the spring (not illustrated) is applied to an operator's finger, which presses the pressing operation member 804, in the drawing direction opposite to a direction of a pressing operation. When the force of the spring (not illustrated) is applied to the finger, the operator can recognize that the lock of the locking mechanism is released.

However, since the force of the spring is set to a force that is required to draw the sheet storage portion 807, a strong force is suddenly applied to the operator's finger at the point of the release of the lock of the locking mechanism. Further, even though pressing the pressing operation member 804, the operator's finger is pushed together with the sheet storage portion 807 in the direction opposite to the pressing direction by the force of the spring that applies a force to the sheet storage portion 807. For this reason, there has been a problem in that the operator's operation feeling is bad.

Accordingly, the invention has been made in consideration of the above-mentioned circumstances, and provides an image forming apparatus and a sheet feeding device that improves operation feeling by allowing an operator to recognize the release of lock when a unit is drawn.

SUMMARY OF THE INVENTION

The invention provides a sheet feeding device including a sheet storage portion mounted on a device main body so as to be drawn from the device main body and the sheet storage portion stores sheets, a sheet feeding portion that feed a sheet from the sheet storage portion, a pushing portion that applies a force to the sheet storage portion in a drawing direction where the sheet storage portion is drawn from the device main body, a locking unit configured to lock the sheet storage portion in the device main body, and a pressing operation member that is pressed in a direction opposite to the drawing direction, wherein a lock of the locking portion is released while interlocking the release of the press of the pressing operation member.

Further, an image forming apparatus of the invention includes a sheet feeding device and an image forming portion that forms an image on a sheet fed from the sheet feeding device.

Further features of the present invention will become apparent from the following description of exemplary embodiments (with reference to the attached drawings).

DESCRIPTION OF THE EMBODIMENTS

An exemplary embodiment of the invention will be described in detail below with reference to drawings. Meanwhile, a case where an image forming apparatus is a copying machine will be described. However, the invention is not limited thereto, and an image forming apparatus may be a printer, a facsimile, or a combined machine thereof.

Figure 1:
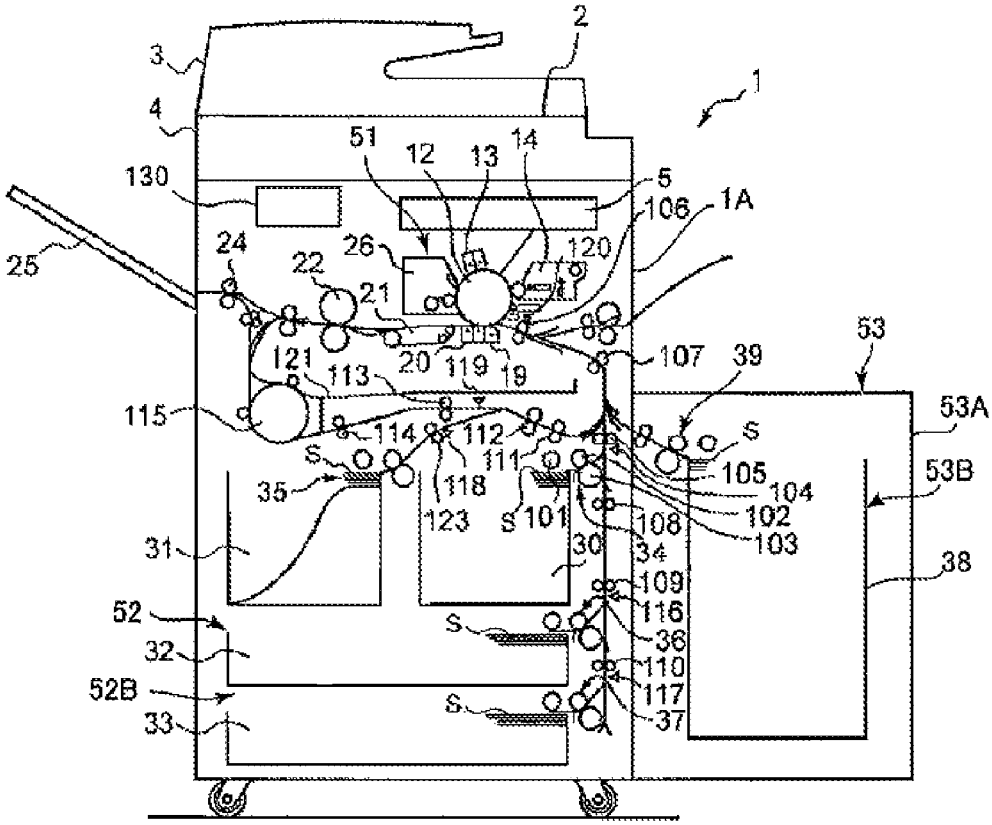
FIG. 1 is a view illustrating the schematic configuration of a copying machine as an example of an image forming apparatus according to an embodiment of the invention.

FIG. 1 is a view illustrating the schematic configuration of a copying machine as an example of an image forming apparatus according to an embodiment of the invention;

A copying machine 1 functions as an image forming apparatus, and a copying machine main body 1A functions as an apparatus main body of the image forming apparatus. The copying machine 1 includes a document reading portion 4 that reads out an image of a document conveyed onto an original base plate 2, a sheet feeding device 52 that is built in the copying machine main body 1A, and a sheet feeding device 53 that is externally attached to the copying machine main body 1A. Meanwhile, the sheet feeding device 53 is detachably attachable to the copying machine main body 1A, and may be mounted on the copying machine main body 1A as needed.

An original base plate 2 formed of a transparent glass plate is fixed to an upper portion of the copying machine main body 1A. A document feeding device 3 conveys a document to a predetermined position on the original base plate 2. Further, the copying machine 1 includes an image forming portion 51 and a control portion 130 in the copying machine main body 1A. The image forming portion 51 is disposed above the sheet feeding device 52, and the control portion 130 controls the entire copying machine.

The sheet feeding device 52 is provided with a unit drawer device 52B that includes cassettes 30, 31, 32, and 33. The cassettes 30, 31, 32, and 33 are sheet storage portions as units mounted on the copying machine main body 1A so as to be drawn from the copying machine main body 1A that is an apparatus main body. Further, the sheet feeding device 52 includes sheet feeding portions 34, 35, 36, and 37 that feed sheets S stored in the respective cassettes 30, 31, 32, and 33.

Furthermore, the sheet feeding device 53 is provided with a unit drawer device 53B that includes a cassette 38. The cassette 38 is a sheet storage portion as a unit mounted on a sheet feeding device main body 53A so as to be drawn from the sheet feeding device main body 53A that is a device main body of the sheet feeding device 53. Moreover, the sheet feeding device 53 includes a sheet feeding portion 39 that feeds sheets S stored in the cassette 38.

The sheet feeding portion 34 includes a pickup roller 101 that feeds the uppermost sheet S of the sheets stored in the cassette 30, and a feed roller 102 and a separating roller 103 that separate and feed the sheets S one by one. Meanwhile, the sheet feeding portions 35, 36, 37, and 39 have substantially the same structure as that of the sheet feeding portion 34.

The image forming portion 51 includes a photosensitive drum 12 as an image bearing member, and a charger 13 that uniformly charges the surface of the photosensitive drum 12 with electricity. Further, the image forming portion 51 includes an exposure device 5 that is formed of a semiconductor laser or the like, exposes the photosensitive drum 12 based on image data processed by the control portion 130, and forms an electrostatic latent image. Further, the image forming portion 51 includes a development device 14. The development device develops the electrostatic latent image formed on the surface of the photosensitive drum 12 so as to form a toner image that is to be transferred to the sheet S. In addition, the image forming portion 51 includes a transfer charger 19 and a separating charger 20. The transfer charger transfers the toner image, which is developed on the surface of the photosensitive drum 12, to the sheet S. The separating charger separates the sheet S to which the toner image has been transferred from the photosensitive drum 12. Moreover, the image forming portion 51 includes a cleaner 26 that removes toner remaining on the photosensitive drum 12 after the transfer of the toner image.

A conveyor belt 21 that conveys the sheet S where the toner image has been transferred (formed) and a fixer 22 that fixes the toner image to the sheet S conveyed by the conveyor belt 21 are provided on the downstream side of the image forming portion 51 in a sheet conveying direction. Further, there is provided a pair of discharge rollers 24 that discharges the sheet S where the toner image has been fixed by the fixer 22 from the copying machine main body 1A, and a discharge tray 25 that receives the sheet S discharged by the pair of discharge rollers 24 is provided on the outside of the copying machine main body 1A.

Furthermore, the copying machine 1 includes a plurality of pairs of conveying rollers 105, 107, 108, 109, 110, 111, 112, and 123. The plurality of pairs of conveying rollers is disposed on a conveying path along which the sheet S is conveyed to the image forming portion 51 from the sheet feeding portions 34 to 37. Further, the copying machine 1 includes a plurality of sheet path sensors 104, 116, 117, and 118. The plurality of sheet path sensors is disposed on the conveying path along which sheet S is conveyed to the image forming portion 51 from the sheet feeding portions 34 to 37, and detects the front and rear ends of the sheet. Meanwhile, the conveying path of the sheet feeding device 53 is joined and connected to a conveying path that is formed between the pairs of conveying rollers 105 and 107.

Further, the sheet S conveyed by the respective pairs of conveying rollers is fed to the image forming portion 51 by a pair of registration rollers 106. A registration sensor 120 is disposed near the upstream side of the pair of registration rollers 106 in the sheet conveying direction to detect the front end of the sheet.

Here, the pair of conveying rollers 107 is pre-registration rollers for feeding the sheet S, which is fed from the each of the sheet feeding portions, to the pair of registration rollers 106. The sheet path sensor 117, the pair of conveying rollers 110, the sheet path sensor 116, the pair of conveying rollers 109, the pair of conveying rollers 108, the sheet path sensor 104, and the pair of conveying rollers 105 are sequentially disposed on a conveying path on the sheet conveying direction on the upstream side of the pair of conveying rollers 107.

Moreover, the pair of conveying rollers 123, the sheet path sensor 118, the pair of conveying rollers 112, and the pair of conveying rollers 111 are sequentially disposed on the conveying path that extends from the sheet feeding portion 35 and is joined and connected to a conveying path formed between the pairs of conveying rollers 105 and 107.

In addition, a sheet reversing path is joined and connected to the conveying path that is formed between the pairs of conveying rollers 123 and 112. A sheet reversing portion 121, a reversing roller 115 that is rotated in normal and reverse directions, a pair of double-side left rollers 114, a pair of double-side right rollers 113, and a sheet path sensor 119 are sequentially disposed on the sheet reversing path from the upstream side.

The image forming operation of the copying machine 1 will be exemplified below by using a case where a sheet S stored in the cassette 30 is fed by the sheet feeding portion 34.

As the photosensitive drum 12 is rotated, the surface of the photosensitive drum 12 is uniformly charged with electricity by the charger 13. Further, the control portion 130 outputs a pulse signal to the semiconductor laser of the exposure device 5 based on digital image signal that is sent from the document reading portion 4, a personal computer, or the like. The semiconductor laser of the exposure device 5 outputs laser light that corresponds to a pulse signal input by the control portion 130. Further, the laser light scans the charged surface of the photosensitive drum 12. An electrostatic latent image is formed on the surface of the photosensitive drum 12 by the scanning of the laser light. The latent image formed on the surface of the photosensitive drum 12 is developed by toner in the development device 14, and forms a visible image.

Meanwhile, the pickup roller 101 is driven together with the toner image forming operation in the sheet feeding device 52 based on a feed start signal, so that the sheets S stored in the cassette 30 are separated and fed one by one by the feed roller 102 and the separating roller 103. Further, the fed sheet S is conveyed by the pairs of conveying rollers 105 and 107, and is guided to the pair of registration rollers 106.

The skew feeding of the sheet S, which is conveyed to the pair of registration rollers 106, is corrected by the pair of registration rollers 106. After that, the front end of the sheet is conveyed by the pair of registration rollers 106 so as to correspond to the front end of the toner image formed on the surface of the photosensitive drum 12 while timing is adjusted.

The toner image formed on the photosensitive drum 12 is transferred to a sheet S, which is to be conveyed, by the transfer charger 19. The sheet S to which the toner image has been transferred is separated from the surface of the photosensitive drum 12 by the separating charger 20.

The sheet S, which is separated from the surface of the photosensitive drum 12, is conveyed by the conveyor belt 21 and is guided to the fixer 22. After that, the sheet S is pressed and heated by the fixer 22, so that the toner image is fixed to the sheet. Then, the sheet is conveyed. Finally, the sheet S is discharged onto the discharge tray 25, which is disposed on the outside of the copying machine main body 1A, by the pair of discharge rollers 24.

Further, in order to form images on both surfaces of the sheet S, the sheet S is guided from the fixer 22 toward the discharge rollers and is guided to the sheet reversing portion 121. Then, the sheet S is reversed by the sheet reversing portion 121 and the reversing roller 115, and is conveyed to the sheet reversing path. The sheet S, which has been conveyed to the sheet reversing path, is conveyed by the pair of double-side left rollers 114, the pair of double-side right rollers 113, the pair of conveying rollers 112, the pair of conveying rollers 111, and the pair of conveying rollers 107. After the skew feeding of the sheet is corrected by the pair of registration rollers 106, the sheet is conveyed again to the image forming portion 51.

Meanwhile, the sheet feeding portion 35, 36, 37, or 39 is operated in order to feed the sheet S from the cassette 31, 32, 33, or 38 for the image forming operation of the copying machine 1.

Here, the cassettes 30, 31, 32, and 33 are mounted on the copying machine main body 1A so as to be drawn from the copying machine main body 1A as an apparatus main body, and the cassette 38 is mounted on the sheet feeding device main body 53A so as to be drawn from the sheet feeding device main body 53A as a device main body. Further, it may be possible to store sheets S in the cassettes 30, 31, 32, 33, and 38 when each of the cassettes 30, 31, 32, 33, and 38 is drawn from the apparatus main body. Each of the cassettes 30, 31, 32, 33, and 38 is provided with a locking mechanism that releasably locks the cassette to the apparatus main body.

Figure 2:
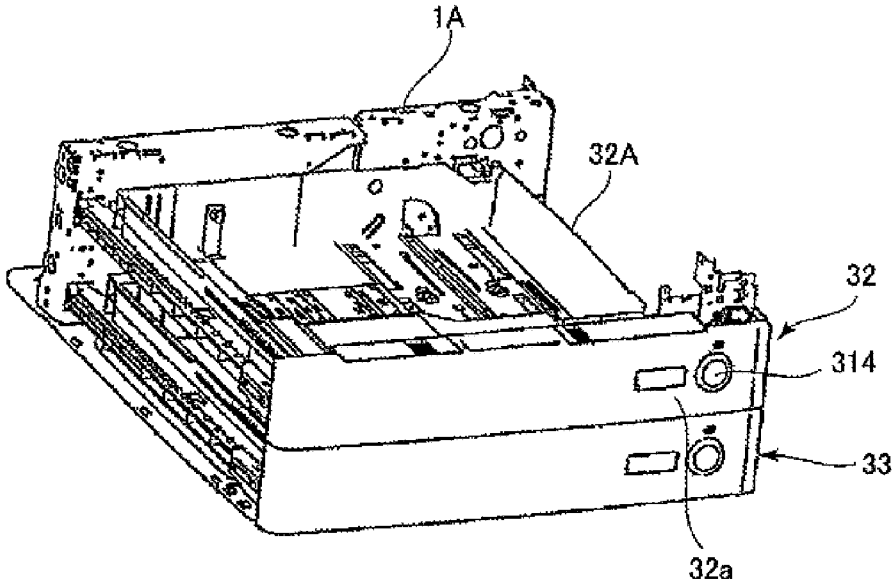
FIG. 2 is a partial perspective view illustrating main parts of the copying machine when cassettes are mounted on a copying machine main body.
Figure 3:
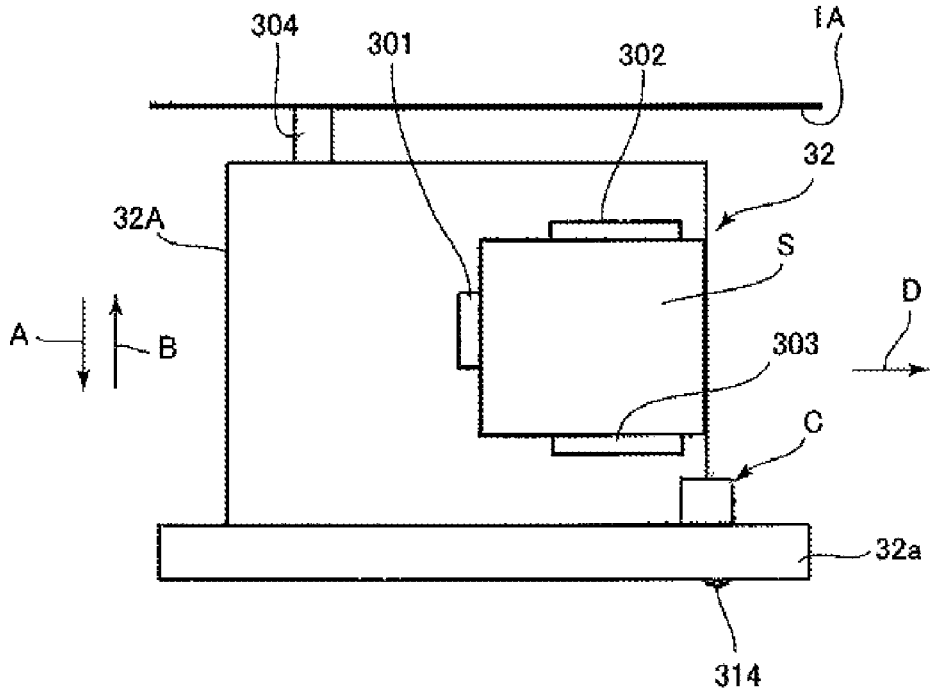
FIG. 3 is a view schematically illustrating a state where the cassette is mounted on the copying machine main body.

FIG. 2 is a partial perspective view illustrating main parts of the copying machine when the cassettes 32 and 33 are mounted on a copying machine main body 1A, and FIG. 3 is a view schematically illustrating a state where the cassette 32 is mounted on the copying machine main body 1A.

Since the internal structures and the locking mechanism s of the respective cassettes 30, 31, 32, 33, and 38 are substantially the same as each other, only the cassette 32 will be described in detail below.

The cassette 32 includes a cassette main body 32A as a unit main body, and a rear end regulating plate 301 that regulates an upstream end (rear end) of the sheet S, which is stacked in the cassette main body 32A, in a sheet feeding direction (a direction of an arrow D). Further, the cassette 32 includes side regulating plates 302 and 303 that regulate ends of the sheet S in a direction orthogonal to the sheet feeding direction. Furthermore, the cassette 32 includes a push-button 314 as a pressing operation member that is pressed in a direction (a direction of an arrow B) opposite to a drawing direction (a direction of an arrow A) by an operator, and a locking mechanism C that releasably locks the cassette main body 32A to the copying machine main body 1A. Here, a front cover 32*a* is provided on the front side, that is, the drawing side of the cassette main body 32A of the cassette 32, and the push-button 314 is provided so as to be exposed to the outside through the front cover 32*a*. A push-out spring 304 as a pushing portion is provided between the cassette main body 32A and the copying machine main body 1A on the rear side, that is, the side opposite to the drawing side of the cassette main body 32A of the cassette 32. A force is applied to the cassette 32 in the direction of the arrow A, which is the drawing direction where the cassette is drawn from the copying machine main body 1A, by the push-out spring 304. However, the cassette 32 mounted on the copying machine main body 1A is locked to the copying machine main body 1A by the locking mechanism C.

Further, when an operator presses the push-button 314, the lock performed by the locking mechanism C is released, so that it may be possible to draw the cassette 32 in the direction of the arrow A. The push-out spring 304 is set to a force that is required to draw the cassette 32.

Figure 4:
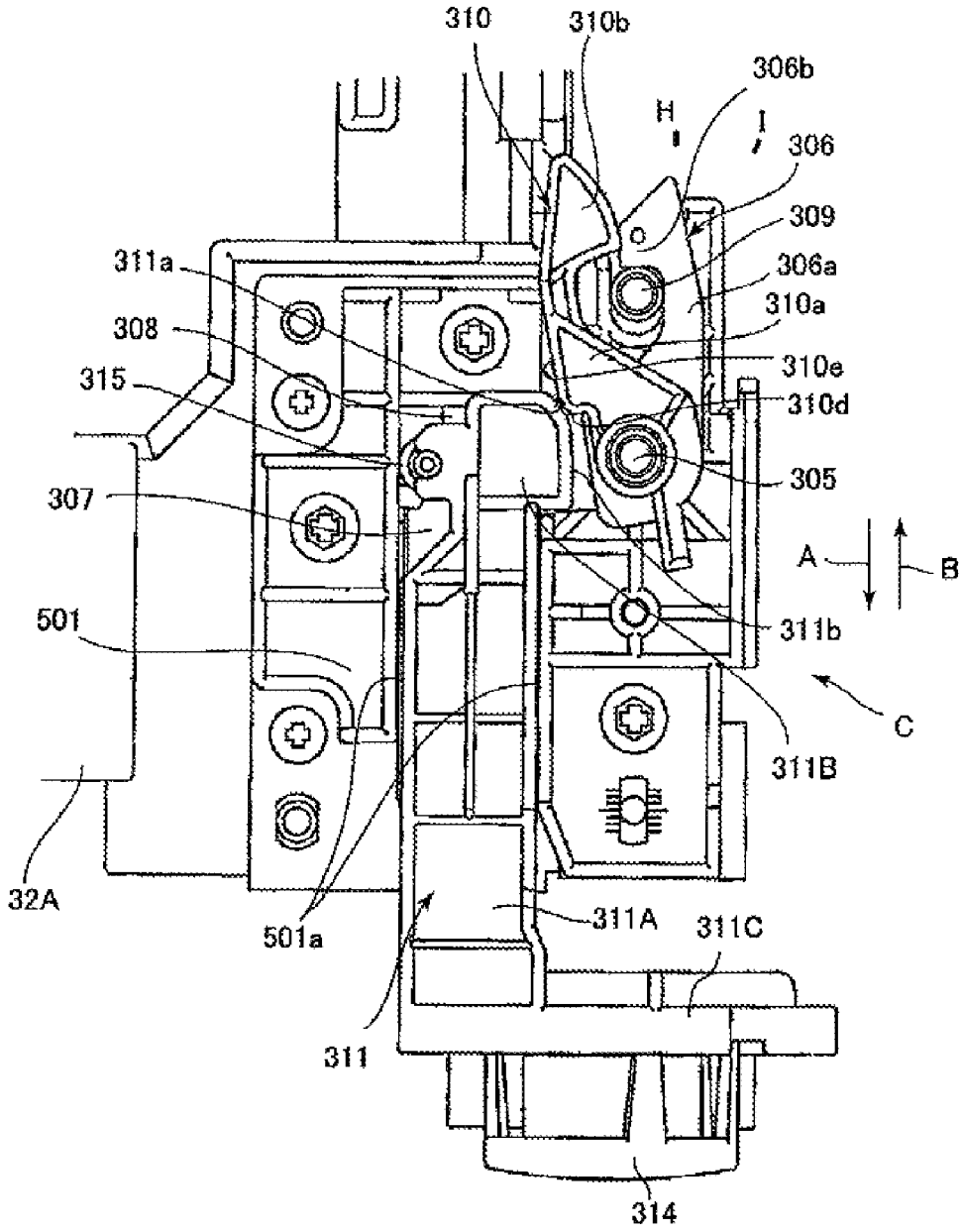
FIG. 4 is a plan view illustrating a locking mechanism of the cassette and the vicinity of the locking mechanism.

The locking mechanism C will be described in detail below. FIG. 4 is a plan view illustrating the locking mechanism C of the cassette 32 and the vicinity of the locking mechanism C.

One positioning pin 309 as a locking portion is provided on the copying machine main body 1A. The locking mechanism C is provided on the outside of the cassette main body 32A, and is provided with first and second hooks 306 and 310 that can be locked to the positioning pin 309.

The cassette main body 32A includes a slide table 501, and a slide groove 501*a*, which extends in a direction parallel to the direction of the arrow A, that is, the drawing direction, is formed on the upper surface of the slide table 501. A hook rotating shaft 305 protrudes from the slide table 501 of the cassette main body 32A.

Figure 5:
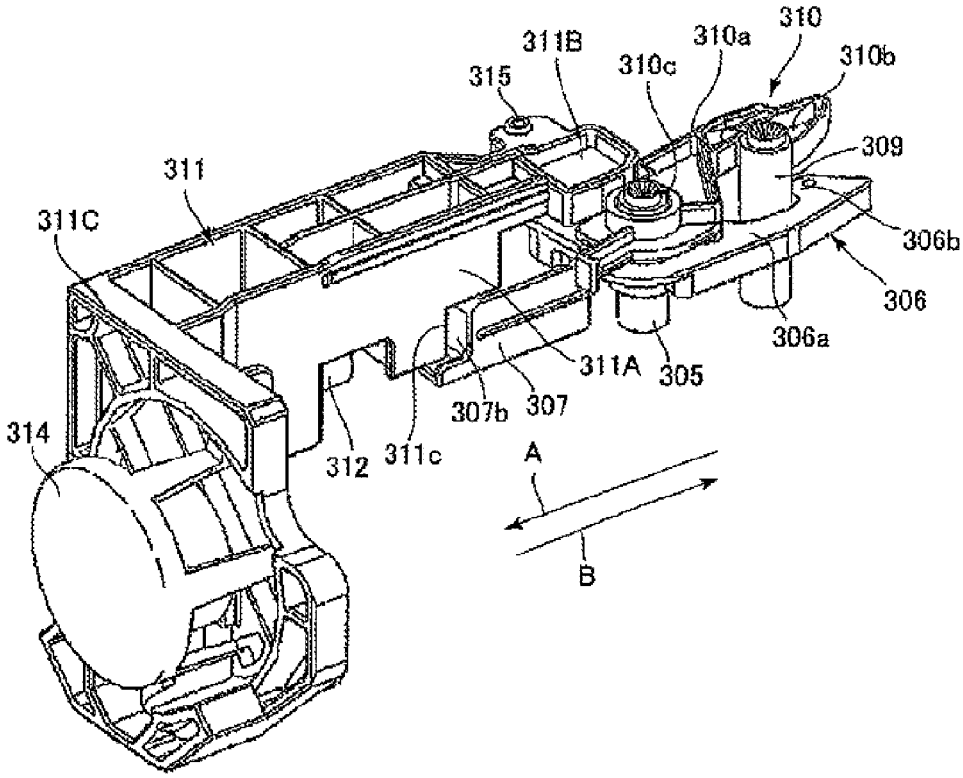
FIG. 5 is a perspective view illustrating the locking mechanism illustrated in FIG. 4 and the vicinity of the locking mechanism.
Figure 6:
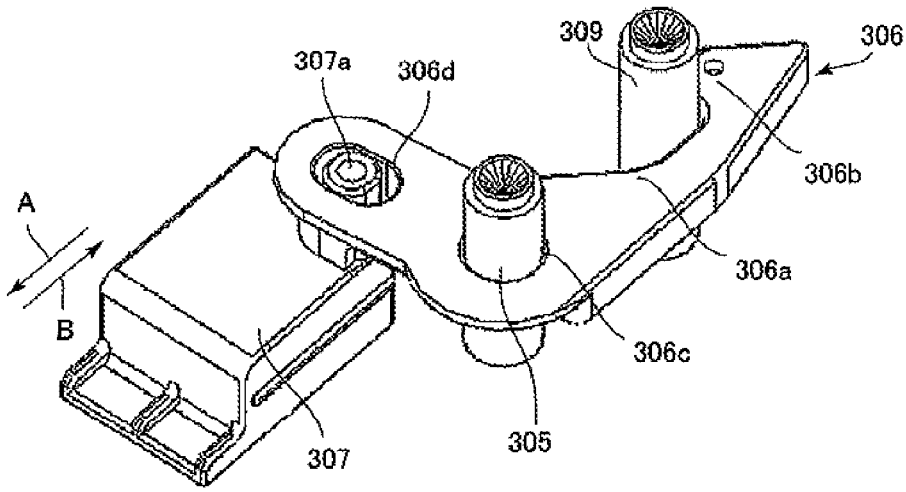
FIG. 6 is a perspective view illustrating a first hook illustrated in FIG. 5 and the vicinity of the first hook.

FIG. 5 is a perspective view illustrating the locking mechanism C illustrated in FIG. 4 and the vicinity of the locking mechanism, and FIG. 6 is a perspective view illustrating the first hook 306 illustrated in FIG. 5 and the vicinity of the first hook.

As illustrated in FIG. 6, the first hook 306 includes a first arm portion 306*a* that is formed to be crooked substantially in the middle thereof, and a first hook portion 306*b* that is formed at the front end of the first arm portion 306*a* and extends from the first arm portion 306*a* so as to be locked to the positioning pin 309. A hole 306*c* is formed substantially in the middle of the first arm portion 306*a*.

As illustrated in FIG. 5, the second hook 310 includes a second arm portion 310*a* that is formed in a substantially linear shape, and a second hook portion 310*b* that is formed at the front end of the second arm portion 310*a* and extends from the second arm portion 310*a* so as to be locked to the positioning pin 309. A hole 310*c* is formed in the vicinity of the base end of the second arm portion 310*a*.

Further, the hook rotating shaft 305 is inserted into the hole 306*c* of the first hook 306 and the hole 310*c* of the second hook 310. Accordingly, the first and second hooks 306 and 310 are disposed so as to be superimposed, and the first arm portion 306*a* of the first hook 306 and the second arm portion 310*a* of the second hook 310 are supported by the cassette main body 32A so as to be rotated about the hook rotating shaft 305. In this embodiment, the second hook 310 is provided on the first hook 306. The first and second hooks 306 and 310 are rotatably supported by one hook rotating shaft 305 as described above, so that the locking mechanism C is made compact.

Here, as illustrated in FIG. 4, the rotational center of the first arm portion 306*a* of the first hook 306 is disposed close to the drawing side, and the front end (first hook portion 306*b*) of the first arm portion 306*a* thereof is disposed close to the side opposite to the drawing side. Furthermore, the rotational center of the second arm portion 310*a* of the second hook 310 is disposed close to the drawing side, and the front end (second hook portion 310*b*) of the second arm portion 310*a* thereof is disposed close to the side opposite to the drawing side. Moreover, the first and second hooks 306 and 310 are disposed so that the first and second hook portions 306*b* and 310*b* face different directions.

As illustrated in FIG. 6, the locking mechanism C includes a first slide member 307 as a moving portion that moves the first hook 306.

As illustrated in FIG. 4, the first slide member 307 is provided on the slide table 501 so as to be slidable along the slide groove 501*a* in a direction parallel to the direction of the arrow A that is the drawing direction. The first slide member 307 is formed to have substantially the same width as that of the slide groove 501*a*, and is disposed in the slide groove 501*a*. Accordingly, the movement of the first slide member 307 is regulated in the width direction of the slide groove 501*a*. Further, as illustrated in FIG. 6, a long hole 306*d* is formed at the first hook 306 in the vicinity of the base end of the first arm portion 306*a*. Further, the first slide member 307 includes a boss 307*a* that is inserted into the long hole 306*d*. Accordingly, the first slide member 307 rotates the first arm portion 306*a* of the first hook 306 by the boss 307*a* while interlocking with a sliding motion that is a linear motion, and moves the first hook portion 306*b* between a lock position H and a lock releasing position I that are illustrated in FIG. 4. Here, the lock position His a position where the first hook portion 306*b* of the first hook 306 is locked to the positioning pin 309 so that the cassette 32 is locked to the copying machine main body 1A. Further, the lock releasing position I is a position where the first hook portion 306*b* of the first hook 306 retracts from the positioning pin 309 so as to release the lock of the cassette 32.

Further, the locking mechanism C includes a spring 308 as a hook pushing portion that is provided on the slide table 501, is abutted against the first slide member 307, and applies a force to the first slide member 307 in the direction of the arrow A that is the drawing direction. The first slide member 307 operates the first arm portion 306*a* by the force of the spring 308 so that the first hook portion 306*b* of the first hook 306 is locked to the positioning pin 309 (the first hook portion 306*b* is moved to the lock position H). That is, the spring 308 applies a force to the first hook 306 through the first slide member 307 so that the first hook portion 306*b* returns to the lock position H where the first hook portion 306*b* is locked to the positioning pin 309. Further, the first slide member 307 slides against the force of the spring 308 in the direction of the arrow B, which is opposite to the drawing direction, so that the first arm portion 306*a* is rotated while interlocking with the sliding motion of the first slide member 307. Accordingly, the first hook portion 306*b* is moved to the lock releasing position I.

Furthermore, the locking mechanism C includes a second slide member 311 as a fixing portion that temporarily fixes the second hook 310.

The second slide member 311 is provided on the slide table 501 so as to be slidable along the slide groove 501*a* in a direction parallel to the direction of the arrow A that is the drawing direction. The second slide member 311 includes a base portion 311A, a front end portion 311B that is provided to the side opposite to the drawing side of the base portion 311A, and a base end portion 311C that is provided to the drawing side of the base portion 311A. The base portion 311A is formed to have substantially the same width as that of the slide groove 501*a*, and is disposed in the slide groove 501*a*.

The second arm portion 310*a* of the second hook 310 is supported so as to be rotated about the hook rotating shaft 305. The push-button 314 is fixed to the base end portion 311C of the second slide member 311. Accordingly, the second slide member 311 is moved together with the push-button 314 in a direction parallel to the direction of the arrow A. Further, the second slide member 311 includes a regulating portion 311*b*. The regulating portion 311*b* is abutted against the second arm portion 310*a* when being moved through the pressing operation of the push-button 314, and regulates the rotation of the second arm portion 310*a* while the second hook portion 310*b* is locked to the positioning pin 309. The regulating portion 311*b* is a surface that is formed at the front end portion 311B and parallel to the drawing direction.

Meanwhile, when the regulating portion 311*b* of the second slide member 311 regulates the movement of the second hook 310, the second slide member 311 regulates the rotation of the second hook 310 to be rotated. Accordingly, the second slide member receives a force applied in a direction orthogonal to the direction of the arrow A. Since the base portion 311A of the second slide member 311 is disposed in the slide groove 501*a* in this embodiment, the movement of the slide groove 501*a* is regulated in the width direction.

Further, the second slide member 311 includes an abutting portion 311*a* that is abutted against the second arm portion 310*a* ahead of the regulating portion 311*b* by the pressing operation of the push-button 314. The abutting portion 311*a* is a surface that is formed at the front end portion 311B and inclined with respect to the drawing direction. That is, the abutting portion 311*a* is to make the second arm portion 310*a* be rotated and to guide the second arm portion 310*a* to the regulating portion 311*b*. Furthermore, an abutted portion 310*d* and a regulated portion 310*e* are formed at the second arm portion 310*a* of the second hook 310. The abutting portion 311*a* is abutted against the abutted portion 310*d*. The regulated portion 310*e* extends toward the side opposite to the drawing side, and the regulating portion 311*b* is abutted against the regulated portion 310*e*. The abutted portion 310*d* is a substantially arcuate crooked surface, and the regulated portion 310*e* is a flat surface.

Moreover, as illustrated in FIG. 5, the first slide member 307 is disposed below the base portion 311A of the second slide member 311. Further, the second slide member 311 includes a pressing portion 311*c* that is abutted against the pressed portion 307*b* of the first slide member 307 through the pressing operation of the push-button 314 and presses the first slide member 307 in the direction of the arrow B. The pressing portion 311*c* protrudes toward the lower side of the base portion 311A. Accordingly, a force is applied to the first slide member 307 in the direction of the arrow A by the spring 308 (FIG. 4), but the second slide member 311 can press and move the first slide member 307 against the force of the spring 308 in the direction of the arrow B. That is, the first slide member 307 is pressed through the second slide member 311 by the pressing operation of the push-button 314, is moved in the direction of the arrow B, and moves the first hook portion 306*b* of the first hook 306 to the lock releasing position I (FIG. 4). Further, when the press of the push-button 314 is released, the first slide member 307 is moved in the direction of the arrow A, which is the drawing direction, by the force of the spring 308 and makes the first hook portion 306*b* of the first hook 306 return to the lock position H (FIG. 4).

As described above, the first and second slide members 307 and 311 are disposed in the slide groove 501*a* while being superimposed. Accordingly, it may be possible to make the locking mechanism C be compact.

Furthermore, as illustrated in FIG. 5, the locking mechanism C includes a spring 312 that is provided on the slide table 501, is abutted against the second slide member 311, and applies a force to the second slide member 311 in the direction of the arrow A. When the push-button 314 fixed to the second slide member 311 is pressed, the second slide member 311 and the push-button 314 are moved against the force of the spring 312 in a direction parallel to the direction of the arrow B. When the press of the push-button 314 is released, the second slide member 311 and the push-button 314 return in the direction of the arrow A by the force of the spring 312.

Moreover, as illustrated in FIG. 4, the locking mechanism C includes a roller 315 that is provided at the second slide member 311 and abutted against the slide groove 501*a*. Accordingly, the second slide member 311 easily slides with small friction.

Figure 7:
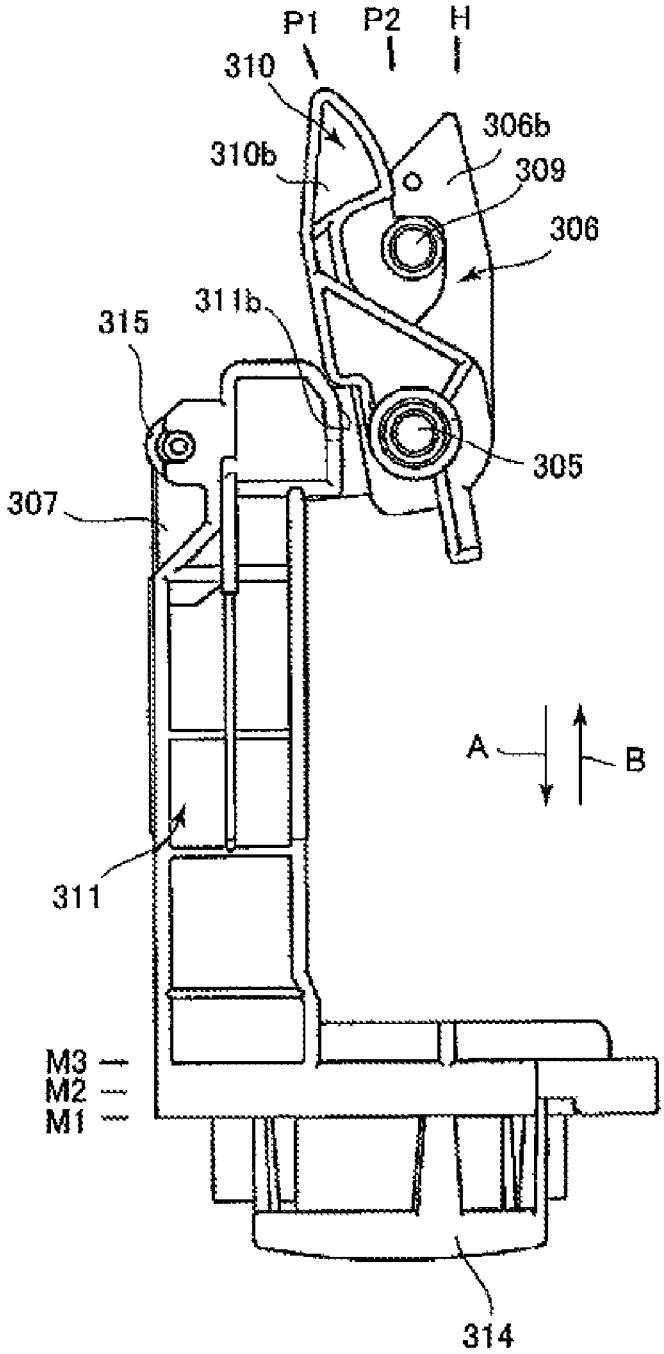
FIG. 7 is a view illustrating a state where a push-button is not pressed when the cassette is mounted on the copying machine main body.

The operation of the locking mechanism C will be described below. FIG. 7 is a view illustrating a state where the push-button 314 is not pressed when the cassette 32 is mounted on the copying machine main body 1A.

As illustrated in FIG. 7, the first hook portion 306*b* of the first hook 306 is held at the lock position H by the force of the spring 308 (FIG. 4) and is locked to the positioning pin 309. The first hook 306 suppresses the protruding of the cassette 32 in the direction of the arrow A that is caused by the force of the push-out spring 304 (FIG. 3), and locks the cassette 32 to the copying machine main body 1A.

Here, since the rotation of the second hook 310 is not regulated by the regulating portion 311*b* of the second slide member 311, the second hook portion 310*b* is movable between a retraction position P1 where the second hook portion 310*b* retracts from the positioning pin 309 and a locking position P2 that the second hook portion 310*b* may be locked to the positioning pin 309. In FIG. 7, the second hook portion 310*b* of the second hook 310 is moved to the retraction position P1. However, even though the second hook portion 310*b* is moved to any position, the subsequent operation is the same.

In this case, as illustrated in FIG. 5, the pressing portion 311*c* of the second slide member 311 is not abutted against the pressed portion 307*b* of the first slide member 307.

Further, since the push-button 314 is not pressed, the second slide member 311 where the push-button 314 is provided is moved to a home position M1 as illustrated in FIG. 7 by the force of the spring 312 (FIG. 5). Meanwhile, in FIG. 7, a moving position M2 is a position of the second slide member 311 that is being moved when the push-button 314 is pressed or released, and a completely pressed position M3 is a position where the pressing operation of the push-button 314 is completed.

Figure 8:
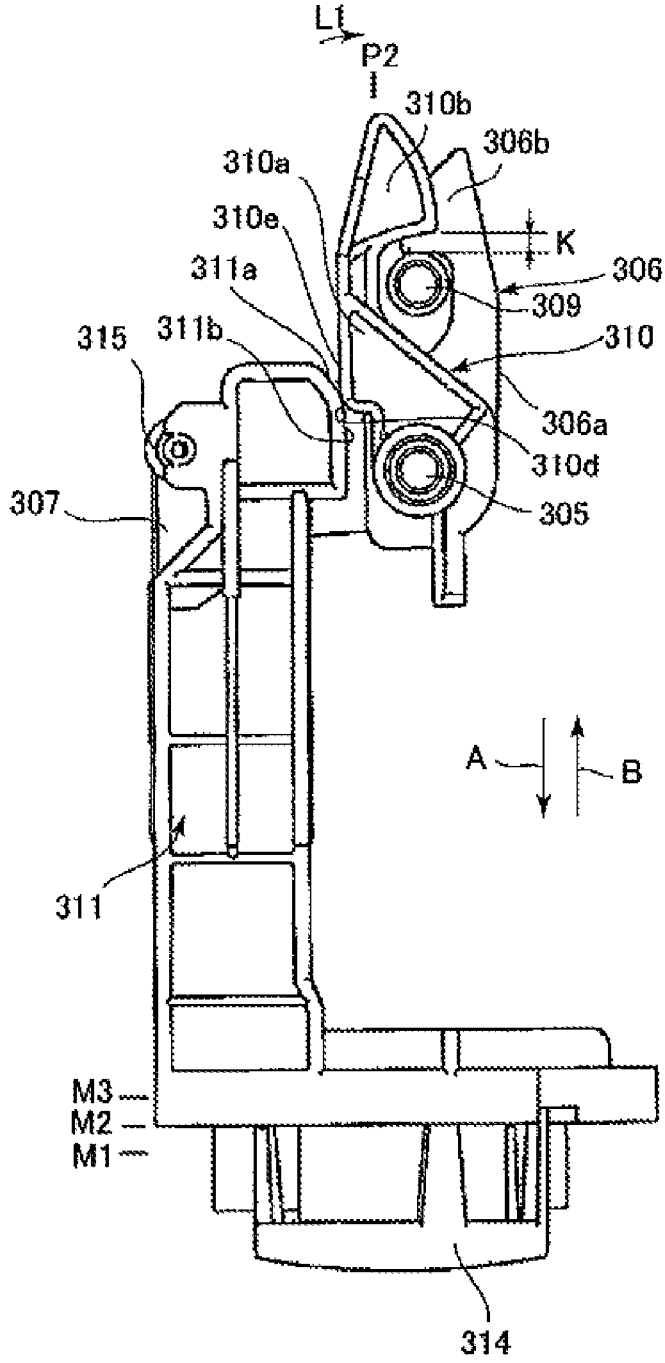
FIG. 8 is a view illustrating a state where the push-button is pressed when the cassette is mounted on the copying machine main body, and a second slide member is moving to a moving position.
Figure 9:
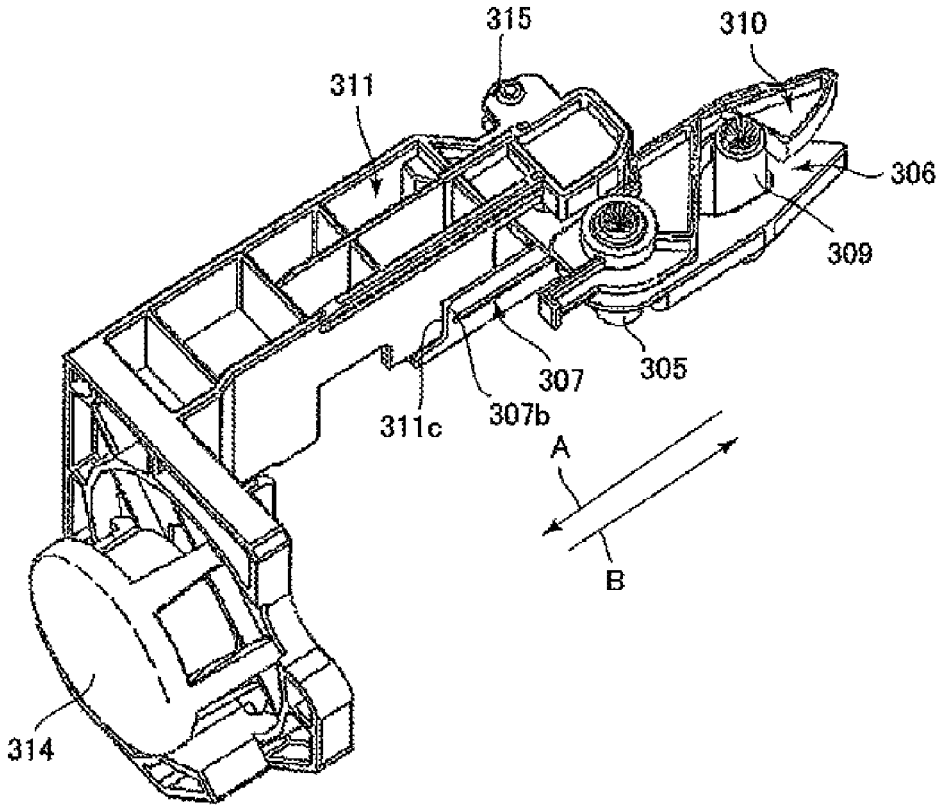
FIG. 9 is a perspective view of FIG. 8.
Figure 10:
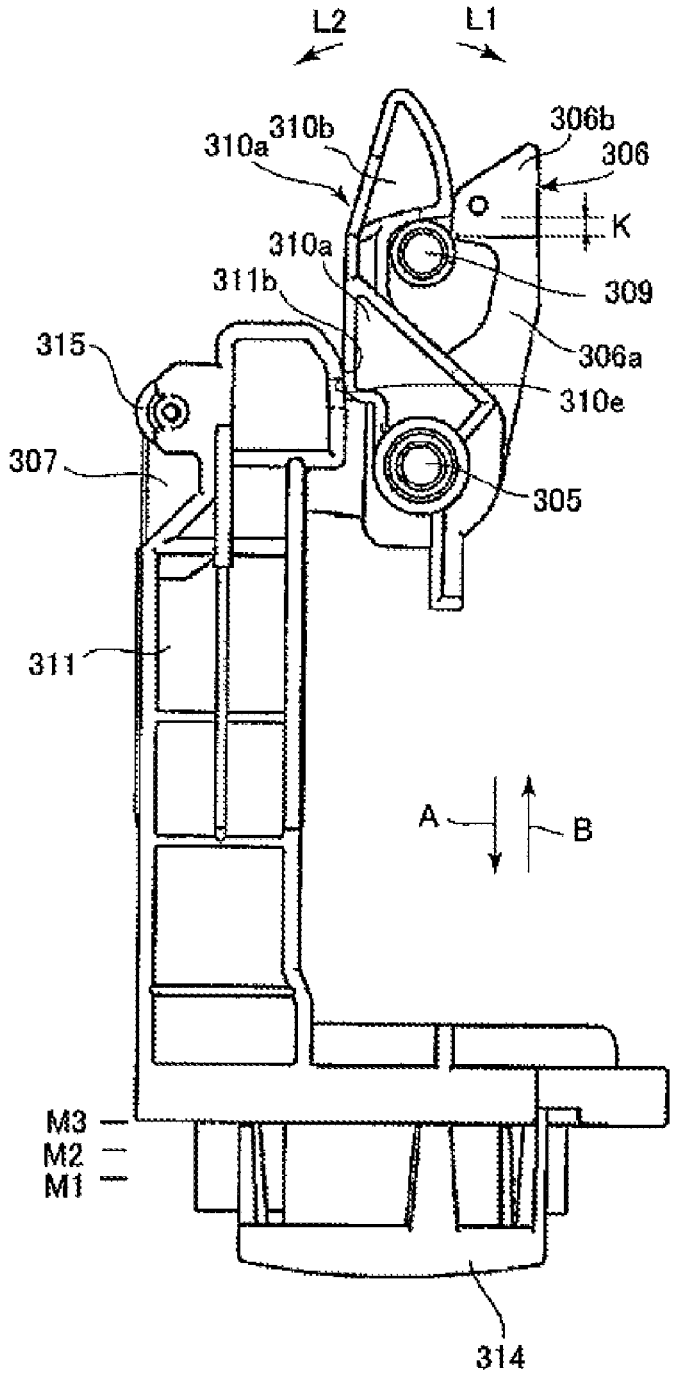
FIG. 10 is a view illustrating a state where the push-button is pressed when the cassette is mounted on the copying machine main body, and a second slide member is moving to a completely pressed position.

FIG. 8 is a view illustrating a state where the push-button 314 is pressed when the cassette 32 is mounted on the copying machine main body 1A, and the second slide member 311 is moving to the moving position M2. Further, FIG. 9 is a perspective view of FIG. 8. Furthermore, FIG. 10 is a view illustrating a state where the push-button 314 is pressed when the cassette 32 is mounted on the copying machine main body 1A, and the second slide member 311 is moving to a completely pressed position M3.

When the push-button 314 is operated in the direction of the arrow B, the second slide member 311 is moved to the moving position M2 as illustrated in FIG. 8. Here, before the second slide member 311 is moved to the moving position M2, the abutting portion 311*a* of the second slide member 311 is abutted against the abutted portion 310*d* of the second hook 310 and the second arm portion 310*a* is rotated in a direction of an arrow L1 by the pressing force of the push-button 314. After that, when the second slide member 311 is moved to the moving position M2, the regulating portion 311*b* of the second slide member 311 is abutted against the regulated portion 310*e* of the second hook 310.

Further, the second slide member 311 temporarily fixes the second hook 310 so that the second hook portion 310*b* is locked to the positioning pin 309 while interlocking with the pressing operation of the push-button 314. That is, the rotation of the second arm portion 310*a* of the second hook 310 is regulated by the abutting of the regulating portion 311*b* of the second slide member 311, and the second hook portion 310*b* is temporarily fixed so as to be locked to the positioning pin 309 while being regulated at the locking position P2.

Furthermore, as illustrated in FIG. 8, the second hook portion 310*b* of the second hook 310 is disposed so as to be slightly deviated from the first hook portion 306*b* of the first hook 306 in a direction opposite to the drawing direction by a predetermined distance K (for example, 1 mm). Accordingly, since the first hook portion 306*b* of the first hook 306 is locked to the positioning pin 309, the second hook portion 310*b* of the second hook 310 is moved to the locking position P2 but is not yet locked to the positioning pin 309.

Meanwhile, the pressing portion 311*c* of the second slide member 311 comes into contact with the pressed portion 307*b* of the first slide member 307 as illustrated in FIG. 9. However, the first slide member 307 is not sliding and the first hook 306 is also held at the lock position H.

Subsequently, when the push-button 314 is further operated as illustrated in FIG. 10, the pressed portion 307*b* (FIG. 5) of the first slide member 307 is pressed in the direction of the arrow B by the pressing portion 311*c* (FIG. 5) of the second slide member 311. Accordingly, the first slide member 307 slides in the direction of the arrow B while interlocking with the pressing operation of the push-button 314, and the first hook portion 306*b* rotates the first arm portion 306*a* against the force of the spring 308 (FIG. 4) in the direction of the arrow L1 so as to retract from the positioning pin 309.

Further, when the second slide member 311 is moved to the completely pressed position M3, the first hook portion 306*b* of the first hook 306 is separated from the positioning pin 309 and moved to the lock releasing position I. Accordingly, the first hook 306 retracts from the positioning pin 309 so as to release the lock of the cassette 32 while interlocking with the pressing operation of the push-button 314.

The lock of the cassette by the first hook 306 is released, so that the cassette 32 is moved in the direction of the arrow A by a predetermined distance K due to the force applied by the push-out spring 304 (FIG. 3). Further, the second hook portion 310*b* of the second hook 310 is locked to the positioning pin 309, so that the cassette 32 is stopped.

In this case, the rotation of the second hook 310 is regulated in the direction of an arrow L2 by the second slide member 311. Accordingly, the second hook portion 310*b* is locked to the positioning pin 309, so that the movement of the cassette 32 is regulated in the direction of the arrow A when the cassette is moved in the direction of the arrow A by a predetermined distance.

Since the cassette 32 is slightly moved from the copying machine main body 1A in the direction of the arrow A only by a predetermined distance K as described above, an operator can recognize that the lock of the cassette 32 is released.

Further, when the cassette 32 is moved only by a predetermined distance K, only a repulsive force of the spring 312 is applied to an operator's finger and the force of the push-out spring 304 is not applied to the operator's finger. Meanwhile, since the push-out spring 304 is set to a large elastic force in order to push out the cassette 32, the spring 312 is set to a relatively small elastic force that is smaller than the elastic force of the push-out spring 304.

Then, after recognizing that the lock of the cassette 32 is released, the operator makes the finger, which presses the push-button 314 in the direction of the arrow B, retract in the direction of the arrow A, so that the press of the push-button 314 is released.

When the press of the push-button 314 positioned at the completely pressed position M3 is released, the second slide member 311 is moved in the direction of the arrow A by the spring 312 (FIG. 5) while interlocking with the release of the press of the push-button 314.

In this case, since the press of the pressed portion 307*b* of the first slide member 307, which is pressed by the pressing portion 311*c* (FIG. 5) of the second slide member 311, is released, the first slide member 307 is to be moved in the direction of the arrow A by the spring 308 (FIG. 4). That is, the first hook portion 306*b* of the first hook 306 is to return to the lock position H, but the cassette 32 is moved in the direction of the arrow A only by a predetermined distance K. Accordingly, the outer surface of the first hook portion 306*b* bumps against the positioning pin 309 and the first hook portion does not return to the lock position H.

Figure 11:
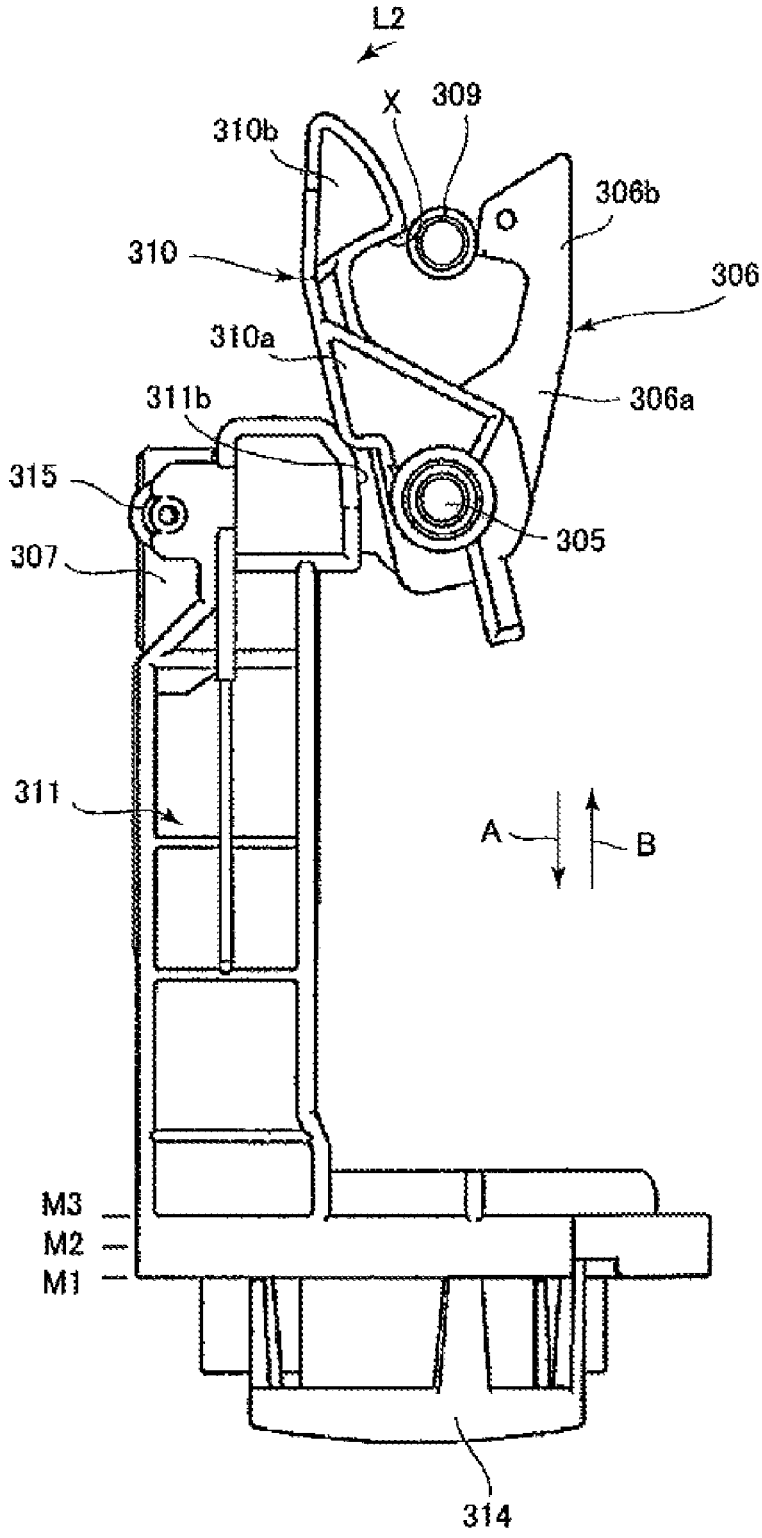
FIG. 11 is a view illustrating a state where the push-button, which has been pressed, is released and returns to a home position.

FIG. 11 is a view illustrating a state where the push-button 314, which has been pressed, is released and returns to the home position M1.

When the press of the push-button 314 is released and the second slide member 311 passes by the moving position M2 as illustrated in FIG. 11, the regulation of the rotation of the second hook 310, which is performed by the regulating portion 311*b* of the second slide member 311, is released. That is, the fixing of the second hook 310, which is performed by the second slide member 311, is released so that the second hook portion 310*b* retracts from the positioning pin 309.

Here, the first hook portion 306*b* has the shape of an arc that has a center at the hook rotating shaft 305. Meanwhile, if the force of the push-out spring 304 is applied to the second hook portion 310*b* when the second hook portion 310*b* is locked to the positioning pin 309, the second hook portion 310*b* is inclined so as to be rotated in the direction of the arrow L2. That is, when the fixing of the second hook portion 310*b*, which is performed by the second slide member 311, is released, a portion X of the second hook portion 310*b* to be locked to the positioning pin 309 is inclined with respect to the circle having a center at the hook rotating shaft 305 so that the second hook portion 310*b* retracts from the positioning pin 309.

Accordingly, the second hook 310 is rotated in the direction of the arrow L2 so that the second hook portion 310*b* retracts from the positioning pin 309 while interlocking with the release of the press of the push-button 314. Therefore, the regulation of the movement of the cassette 32 is released in the direction of the arrow A.

Further, if the second hook 310 is separated from the positioning pin 309, the cassette 32 is drawn from the copying machine main body 1A by the force of the push-out spring 304 (FIG. 3).

In this case, since the operator's finger moves the push-button 314 in the same direction as the drawing direction, the push-button is moved in the same direction as the direction where the cassette 32 is drawn. Accordingly, the force of the push-out spring 304 is hardly applied to the operator's finger, and operation feeling is improved without operator's uncomfortable feeling when the cassette 32 is drawn.

Figure 12:
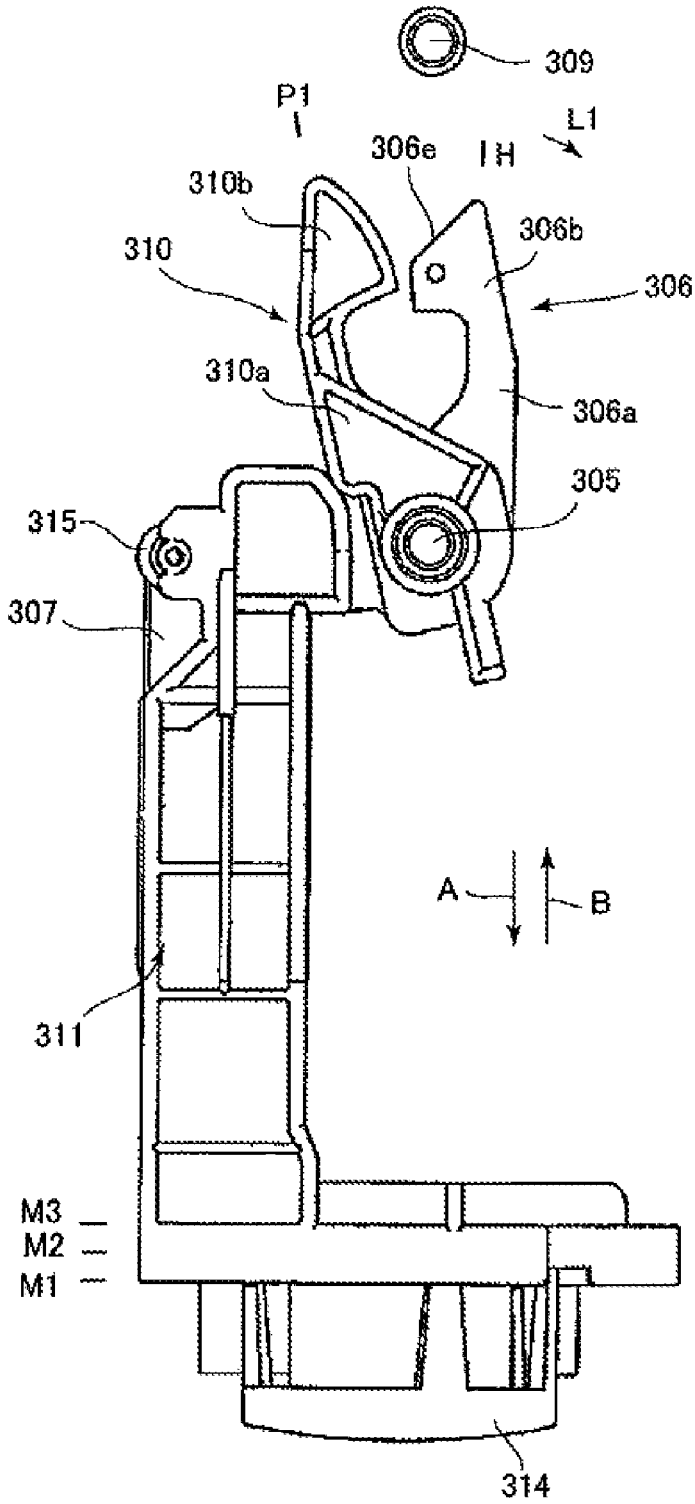
FIG. 12 is a view illustrating a state where the cassette is drawn from the copying machine main body.
Figure 13:
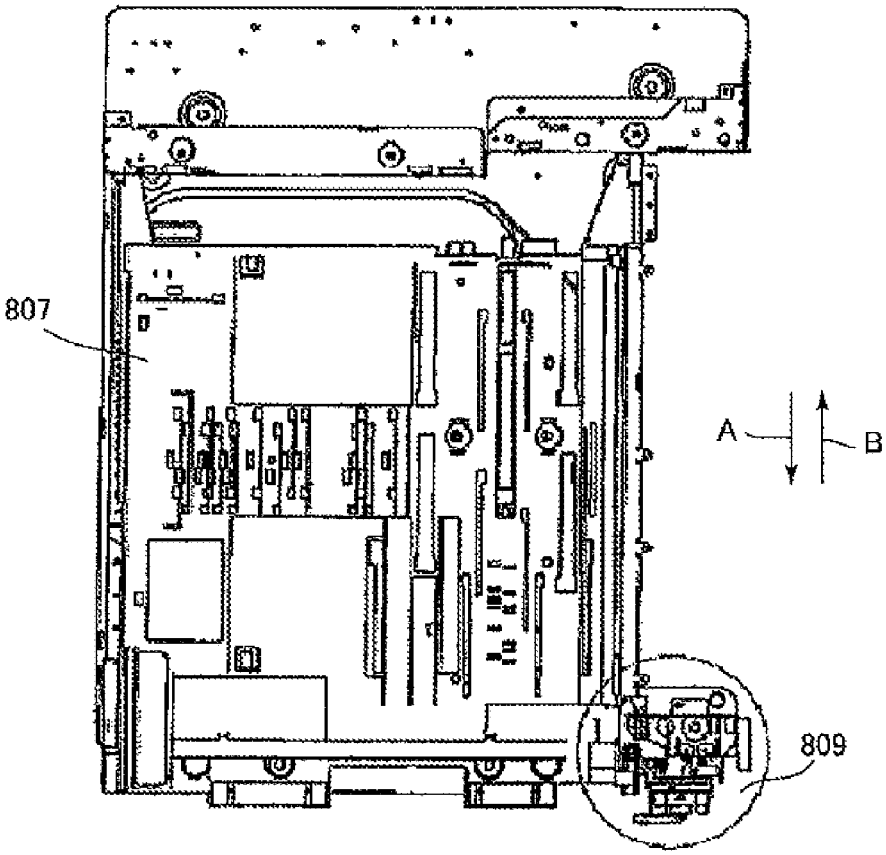
FIG. 13 PRIOR ART
FIG. 13 is a plan view illustrating a part of an apparatus main body and a sheet storage portion in the related art.
Figure 14:
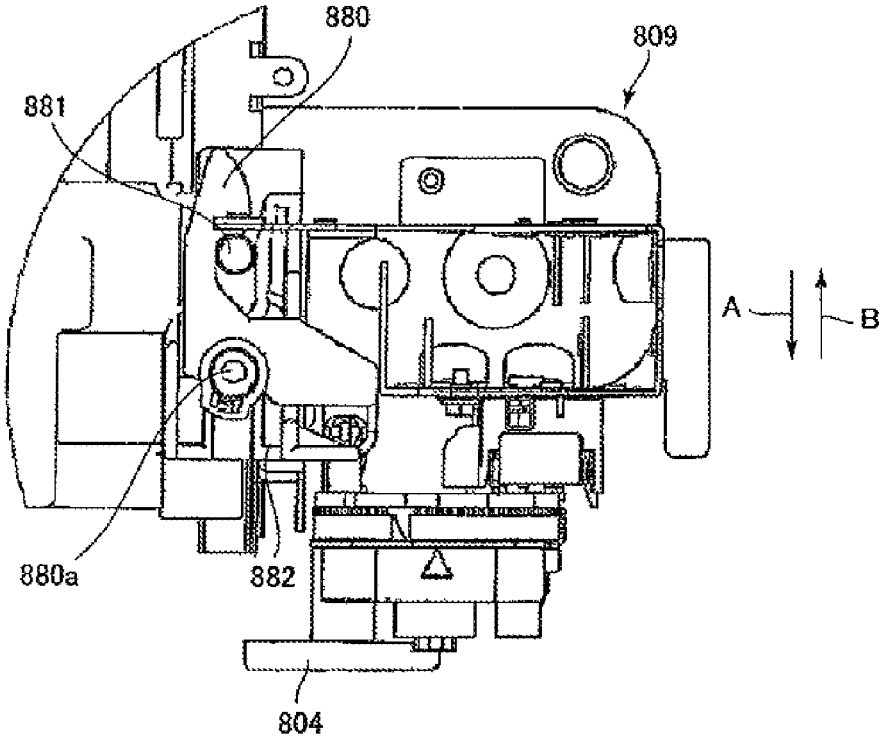
FIG. 14 PRIOR ART
FIG. 14 is an enlarged plan view of the vicinity of a locking mechanism illustrated in FIG. 13.

FIG. 12 is a view illustrating a state where the cassette 32 is drawn from the copying machine main body 1A. Since a force is applied to the first slide member 307 by the spring 308 (FIG. 4), the first hook portion 306*b* of the first hook 306 is moved to the lock position H as illustrated in FIG. 12.

Meanwhile, after an operator stacks sheets in the cassette 32 drawn from the copying machine main body 1A, the front cover 32*a* (FIG. 3) is operated in the direction of the arrow B so that the cassette 32 is mounted on the copying machine main body 1A. In this case, an inclined surface 306*e* formed on the outer surface of the first hook portion 306*b* bumps against the positioning pin 309 and the first arm portion 306*a* is rotated in the direction of the arrow L1. Further, after the first hook portion 306*b* passes by the positioning pin 309, the first hook portion 306*b* is moved to the lock position H by the force of the spring 308 (FIG. 4) and locked to the positioning pin 309.

Further, when operator removes one's own hand from the front cover 32*a*, a force is applied to the cassette 32 in the drawing direction by the push-out spring 304 (FIG. 3). However, since the first hook portion 306*b* is locked to the positioning pin 309, the cassette 32 is held while being mounted on the copying machine main body 1A.

Here, since being provided with the same locking mechanism as that of the cassette 32, each of the cassettes 30, 31, 33, and 38 operates like the cassette 32. Accordingly, it may be possible to obtain an advantage of improving operation feeling without operator's uncomfortable feeling when the cassette is drawn.

Meanwhile, the invention has been described based on the above-mentioned embodiment, but the invention is not limited thereto.

The second hook portion 310*b* has been disposed so as to be deviated from the first hook portion 306*b* in a direction opposite to the drawing direction by a predetermined distance K in the above-mentioned embodiment, but the invention is not limited thereto. An elastic body made of rubber may be provided at a locking portion of the second hook portion, and the elastic body is elastically deformed (for example, compressed) when being locked to the positioning pin, so that the cassette may be moved by a predetermined distance K. Even in this case, it may be possible to obtain the same advantages as those of the above-mentioned embodiment. Further, since the elastic body is made of a cushioning material, a shock is absorbed even when the cassette is moved by a predetermined distance. Accordingly, the operator's operation feeling is significantly improved.

Further, in the above-mentioned embodiment, there has been described a case where the sheet feeding devices 52 and 53 are provided with the unit drawer devices 52B and 53B, respectively, and the cassettes 30, 31, 32, 33, and 38 are units mounted on the apparatus main body so as to be drawn from the apparatus main body. The invention is not limited thereto. The invention may be applied to various units (such as a toner cartridge that stores toner, a process cartridge that receives components of an image forming portion, and a conveying unit that conveys a sheet) that are mounted on an image forming apparatus so as to be drawn from the image forming apparatus.

Furthermore, in the above-mentioned embodiment, there has been described a case where one positioning pin is used as the locking portion and the first and second hooks are locked to the positioning pin. However, the invention is not limited thereto. Although not illustrated, two positioning pins, which are distant from each other in a direction orthogonal to the drawing direction, may be used as the locking portion, and the hooks may be disposed so as to be locked to the positioning pins, respectively.

Moreover, in the above-mentioned embodiment, there has been described a case where the hook portions of the respective hooks are supported by the hook rotating shaft so as to face different directions. However, the hook portions of the respective hooks may be supported by the hook rotating shaft so as to face the same direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-018817, filed Jan. 29, 2009, which is hereby incorporated by reference herein in its entirety.

What is claimed is:

1. A sheet feeding device comprising:

a sheet storage portion mounted on a device main body so as to be drawn from the device main body and the sheet storage portion stores sheets;

a sheet feeding portion that feeds a sheet from the sheet storage portion;

a pushing portion that applies a force to the sheet storage portion in a drawing direction where the sheet storage portion is drawn from the device main body;

a locking mechanism configured to regulate a movement of the sheet storage portion in the device main body against the force of the pushing portion; and a pressing operation member that is pressed in a direction opposite to the drawing direction to release a regulation of the sheet storage portion by the locking mechanism, wherein the locking mechanism includes a locking portion that is provided at the device main body;

a first hook portion and a second hook portion rotatably provided at the sheet storage portion and which regulate a movement of the sheet storage portion in the device main body by engaging the locking portion, an engage position of the second hook portion and the locking portion disposed so as to be deviated at a predetermined distance from an engage position of the first hook portion and the locking portion in a direction opposite to the drawing direction;

a hook pushing portion that applies a force to the first hook portion to engage the locking portion;

a moving portion that moves the first hook portion against the force of the hook pushing portion so that the first hook portion retracts from the locking portion while interlocking with the pressing operation of the pressing operation member; and a fixing portion that temporarily fixes the second hook portion to engage the locking portion while interlocking with the pressing operation of the pressing operation member, and releases the fixing of the second hook portion to retract from the locking portion while interlocking with the release of the press of the pressing operation member, wherein when the regulation of the sheet storage portion by an engagement of the first hook portion and the locking portion is released, the sheet storage portion is moved in the drawing direction by the predetermined distance and is regulated by an engagement of the second hook portion and the locking portion, and the second hook portion releases the engagement with the locking portion while interlocking with the release of the press of the pressing operation member to move the sheet storage portion by the pushing portion in the drawing direction.

2. The sheet feeding device according to claim 1, wherein the second hook portion is inclined so as to retract from the locking portion when the fixing performed by the fixing portion is released.

3. The sheet feeding device according to claim 1, wherein the moving portion is a first slide member that is provided so as to be slidable in a direction parallel to the drawing direction, is operated to rotate the first portion while interlocking with the sliding motion, and receives a force applied in the drawing direction by the hook pushing portion so that the first hook portion is engaged with the locking portion, wherein the fixing portion is a second slide member which is provided so as to be slidable in a direction parallel to the drawing direction and to which the pressing operation member is fixed, and wherein the second slide member includes a pressing portion that presses the first slide member against the force of the hook pushing portion in a direction opposite to the drawing direction by the pressing operation of the pressing operation member, and a regulating portion that is abutted against the second hook portion by the pressing operation of the pressing operation member so as to regulate the rotation of the second hook portion while the second hook portion is engaged with the locking portion.

4. An image forming apparatus comprising:

a sheet feeding device; and an image forming portion that forms an image on a sheet fed from the sheet feeding device, wherein the sheet feeding device includes a sheet storage portion that is mounted on a device main body so as to be drawn from the device main body and the sheet storage portion stores sheets;

a sheet feeding portion that feeds a sheet from the sheet storage portion;

a pushing portion that applies a force to the sheet storage portion in a drawing direction where the sheet storage portion is drawn from the device main body; and a locking mechanism configured to regulate a movement of the sheet storage portion in the device main body against the force of the pushing portion, and a pressing operation member that is pressed in a direction opposite to the drawing direction and releases a regulation of the sheet storage portion by the locking mechanism, wherein the locking mechanism includes a locking portion that is provided at the device main body;

a first hook portion and a second hook portion rotatably provided at the sheet storage portion and which regulate a movement of the sheet storage portion in the device main body by engaging the locking portion, an engage position of the second hook portion and the locking portion disposed so as to be deviated at a predetermined distance from an engage position of the first hook portion and the locking portion in a direction opposite to the drawing direction, a hook pushing portion that applies a force to the first hook portion to engage the locking portion;

a moving portion that moves the first hook portion against the force of the hook pushing portion so that the first hook portion retracts from the locking portion while interlocking with the pressing operation of the pressing operation member; and a fixing portion that temporarily fixes the second hook portion to engage the locking portion while interlocking with the pressing operation of the pressing operation member, and releases the fixing of the second hook portion to retract from the locking portion while interlocking with the release of the press of the pressing operation member, wherein when the regulation of the sheet storage portion by an engagement of the first hook portion and the locking portion is released, the sheet storage portion is moved in the drawing direction by the predetermined distance and is regulated by an engagement of the second hook portion and the locking portion, and the second hook portion releases the engagement with the locking portion while interlocking with the release of the press of the pressing operation member to move the sheet storage portion by the pushing portion in the drawing direction.

5. The image forming apparatus according to claim 4, wherein the second hook portion is inclined so as to retract from the locking portion when the fixing performed by the fixing portion is released.

6. The image forming apparatus according to claim 4, wherein the moving portion is a first slide member that is provided so as to be slidable in a direction parallel to the drawing direction, is operated to rotate the first hook portion while interlocking with the sliding motion, and receives a force applied in the drawing direction by the hook pushing portion so that the first hook portion is engaged with the locking portion, wherein the fixing portion is a second slide member which is provided so as to be slidable in the drawing direction and to which the pressing operation member is fixed, and wherein the second slide member includes a pressing portion that presses the first slide member against the force of the hook pushing portion in a direction opposite to the drawing direction by the pressing operation of the pressing operation member, and a regulating portion that is abutted against the second hook portion by the pressing operation of the pressing operation member so as to regulate the rotation of the second hook portion while the second hook portion is engaged with the locking portion.

* * * * *